US011060365B2

(12) United States Patent
Kapila et al.

(10) Patent No.: US 11,060,365 B2
(45) Date of Patent: Jul. 13, 2021

(54) CONTINUOUS SOLIDS DISCHARGE

(71) Applicant: Halliburton Energy Services, Inc., Houston, TX (US)

(72) Inventors: Rajesh C. Kapila, Houston, TX (US); Barry Hoffman, Wilcox (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/856,965

(22) Filed: Apr. 23, 2020

(65) Prior Publication Data

US 2020/0399966 A1 Dec. 24, 2020

(51) Int. Cl.

| | |
|---|---|
| ***E21B 21/06*** | (2006.01) |
| ***E21B 21/10*** | (2006.01) |
| ***B01F 5/04*** | (2006.01) |
| *E21B 21/01* | (2006.01) |

(52) U.S. Cl.

CPC ..... *E21B 21/066* (2013.01); *B01F 5/043* (2013.01); *E21B 21/106* (2013.01); *E21B 21/01* (2013.01)

(58) Field of Classification Search

CPC ..... E21B 21/063; E21B 21/065; E21B 21/066
See application file for complete search history.

(56) References Cited

U.S. PATENT DOCUMENTS

| | | | | |
|---|---|---|---|---|
| 4,319,410 | A | 3/1982 | Heilhecker et al. | |
| 4,752,135 | A | 6/1988 | Loomans | |
| 5,017,269 | A | 5/1991 | Loomans et al. | |
| 5,110,457 | A * | 5/1992 | Krawl | B03B 9/00 209/17 |
| 5,164,207 | A | 11/1992 | Durina | |
| 5,544,951 | A | 8/1996 | Alack | |
| 6,220,745 | B1 | 4/2001 | Kobayashi et al. | |
| 8,496,189 | B2 | 7/2013 | Lomond et al. | |
| 2014/0000720 | A1* | 1/2014 | Mortzheim | B01F 15/0235 137/1 |
| 2014/0110358 | A1 | 4/2014 | Lang | |
| 2015/0060044 | A1 | 3/2015 | Scharmach et al. | |
| 2015/0338162 | A1 | 11/2015 | Hoffman | |
| 2016/0059194 | A1 | 3/2016 | Smith | |
| 2016/0265322 | A1 | 9/2016 | Beg | |
| 2018/0010031 | A1 | 1/2018 | Galindo et al. | |
| 2019/0106972 | A1 | 4/2019 | Sanborn et al. | |

* cited by examiner

*Primary Examiner* — Kristyn A Hall
(74) *Attorney, Agent, or Firm* — Tenley Krueger; Parker Justiss, P.C.

(57) ABSTRACT

A solids discharge assembly for disposing of oil and gas well treated solids, the assembly including a discharge eductor and solids valve. The eductor includes a solids inlet, a fluid inlet, and a discharge outlet. Method and system embodiments for disposing of oil or gas well treated solids are also disclosed.

22 Claims, 4 Drawing Sheets

Figure 3B:
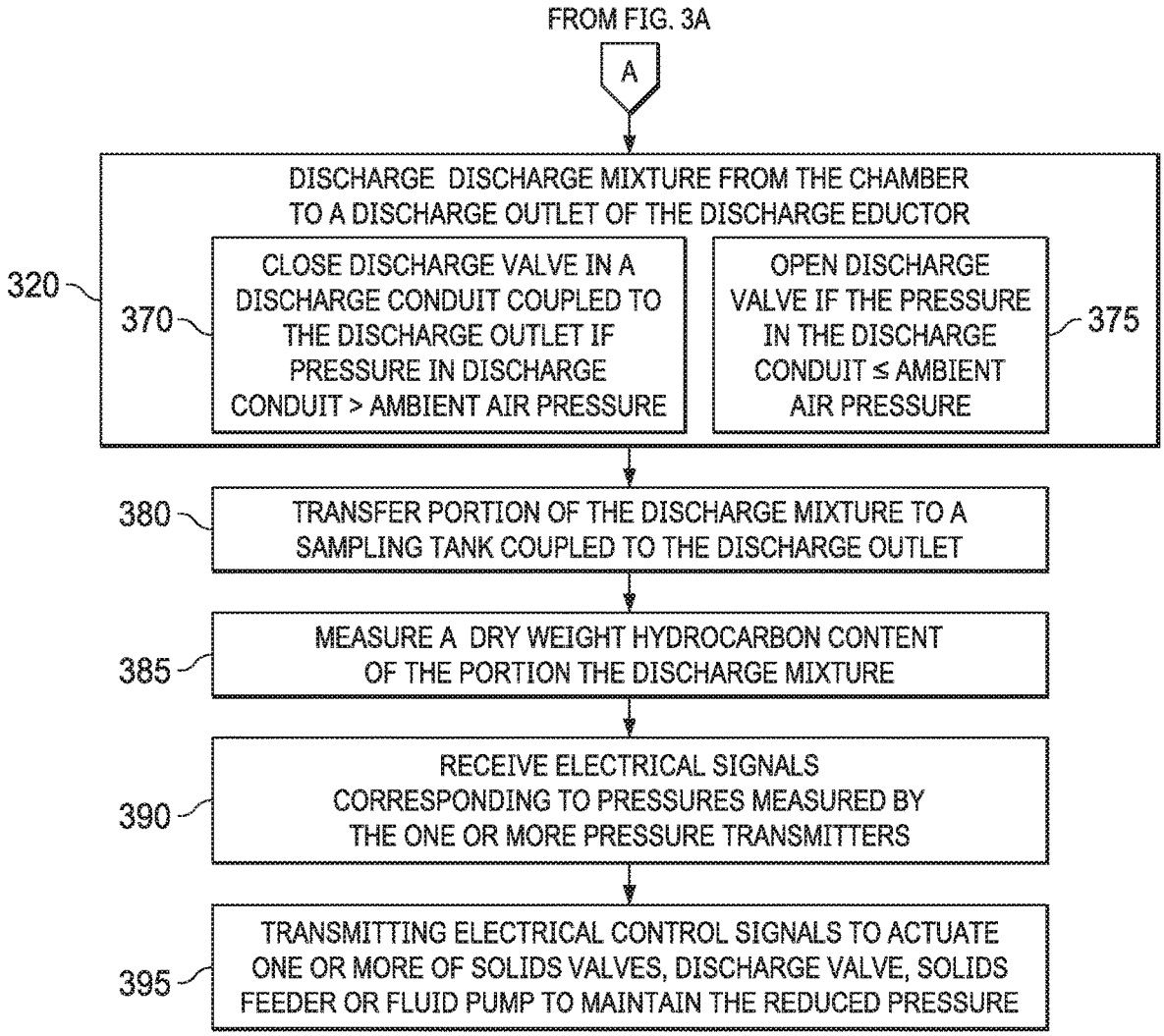

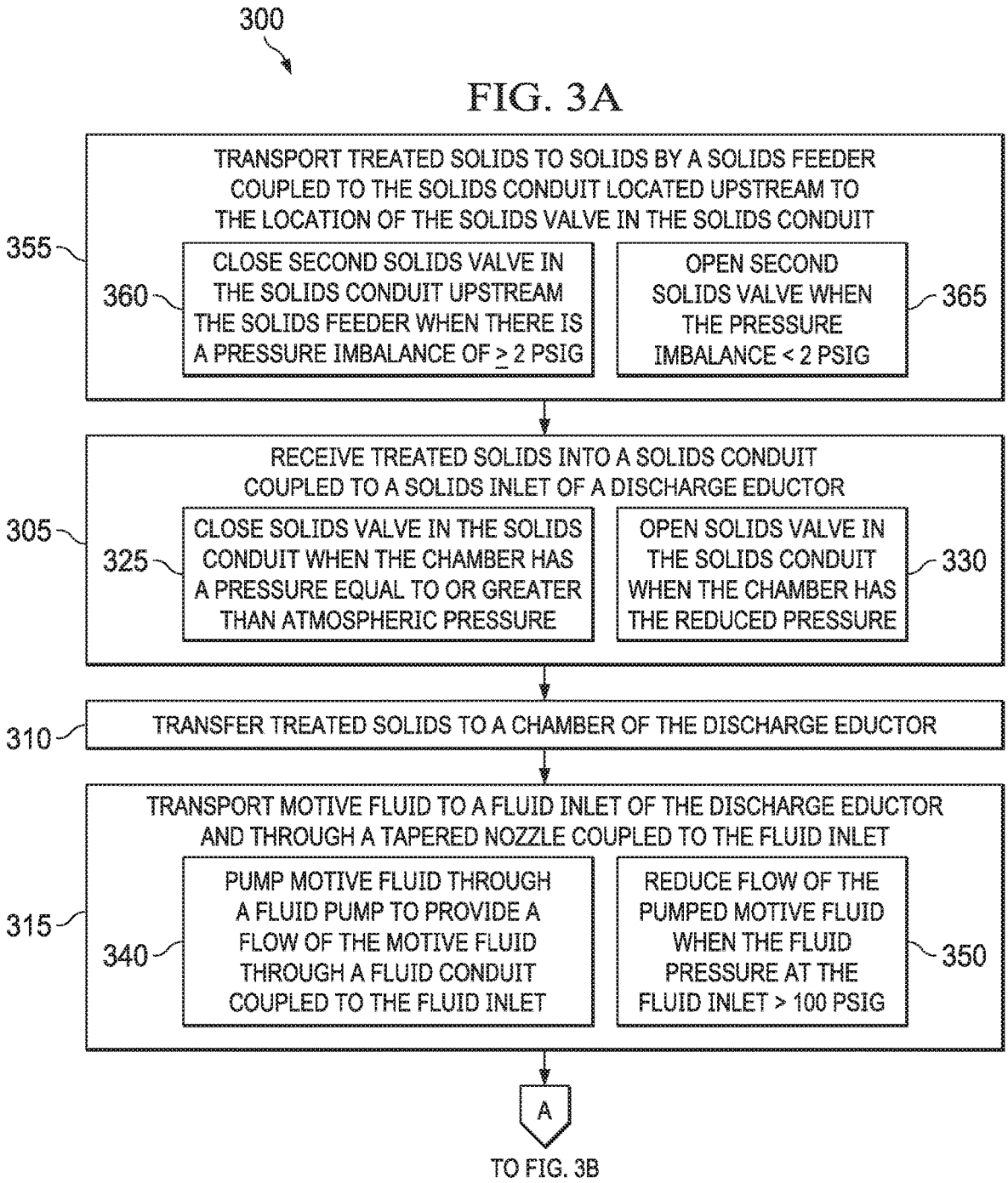
300
FIG. 3A
TRANSPORT TREATED SOLIDS TO SOLIDS BY A SOLIDS FEEDER COUPLED TO THE SOLIDS CONDUIT LOCATED UPSTREAM TO THE LOCATION OF THE SOLIDS VALVE IN THE SOLIDS CONDUIT
355
360
CLOSE SECOND SOLIDS VALVE IN THE SOLIDS CONDUIT UPSTREAM THE SOLIDS FEEDER WHEN THERE IS A PRESSURE IMBALANCE OF ≥ 2 PSIG
OPEN SECOND SOLIDS VALVE WHEN THE PRESSURE IMBALANCE < 2 PSIG
365
RECEIVE TREATED SOLIDS INTO A SOLIDS CONDUIT COUPLED TO A SOLIDS INLET OF A DISCHARGE EDUCTOR
305
325
CLOSE SOLIDS VALVE IN THE SOLIDS CONDUIT WHEN THE CHAMBER HAS A PRESSURE EQUAL TO OR GREATER THAN ATMOSPHERIC PRESSURE
OPEN SOLIDS VALVE IN THE SOLIDS CONDUIT WHEN THE CHAMBER HAS THE REDUCED PRESSURE
330
310
TRANSFER TREATED SOLIDS TO A CHAMBER OF THE DISCHARGE EDUCTOR
TRANSPORT MOTIVE FLUID TO A FLUID INLET OF THE DISCHARGE EDUCTOR AND THROUGH A TAPERED NOZZLE COUPLED TO THE FLUID INLET
315
340
PUMP MOTIVE FLUID THROUGH A FLUID PUMP TO PROVIDE A FLOW OF THE MOTIVE FLUID THROUGH A FLUID CONDUIT COUPLED TO THE FLUID INLET
REDUCE FLOW OF THE PUMPED MOTIVE FLUID WHEN THE FLUID PRESSURE AT THE FLUID INLET > 100 PSIG
350
A
TO FIG. 3B

CONTINUOUS SOLIDS DISCHARGE

CROSS-REFERENCE TO RELATED APPLICATION

This application is a continuation of and claims priority to International Application Serial No. PCT/US2019/038473 filed on Jun. 21, 2019, and entitled "CONTINUOUS SOLIDS DISCHARGE," which is commonly assigned with this application and incorporated herein by reference in its entirety.

BACKGROUND

As oil and gas well drilling fluids are used, downhole waste solids accumulate. The environmentally safe and cost-effective removal of such waste solids is important to the efficient operation of oil and gas well drilling systems.

BRIEF DESCRIPTION

Figure 1:
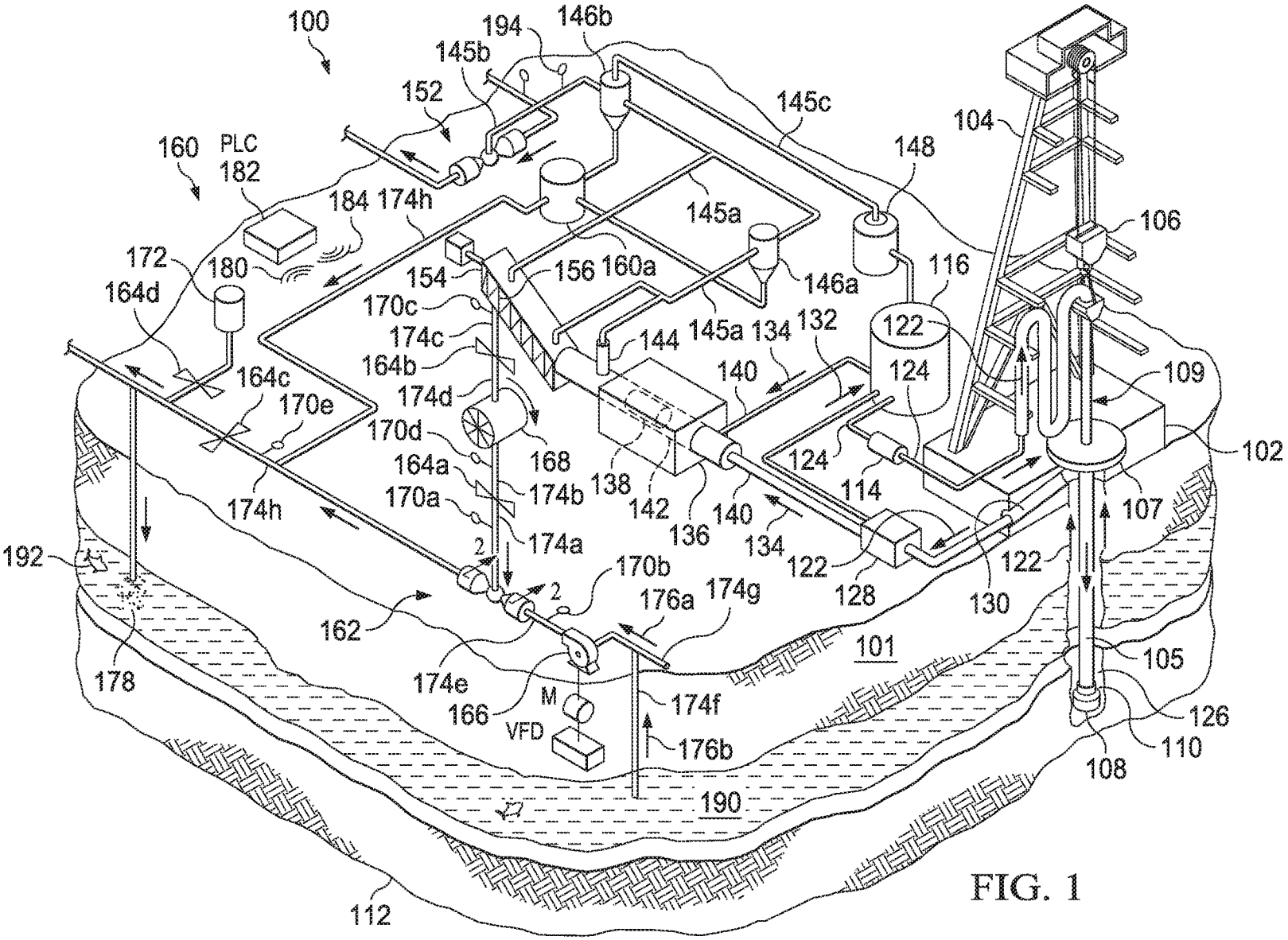
Figure 2:
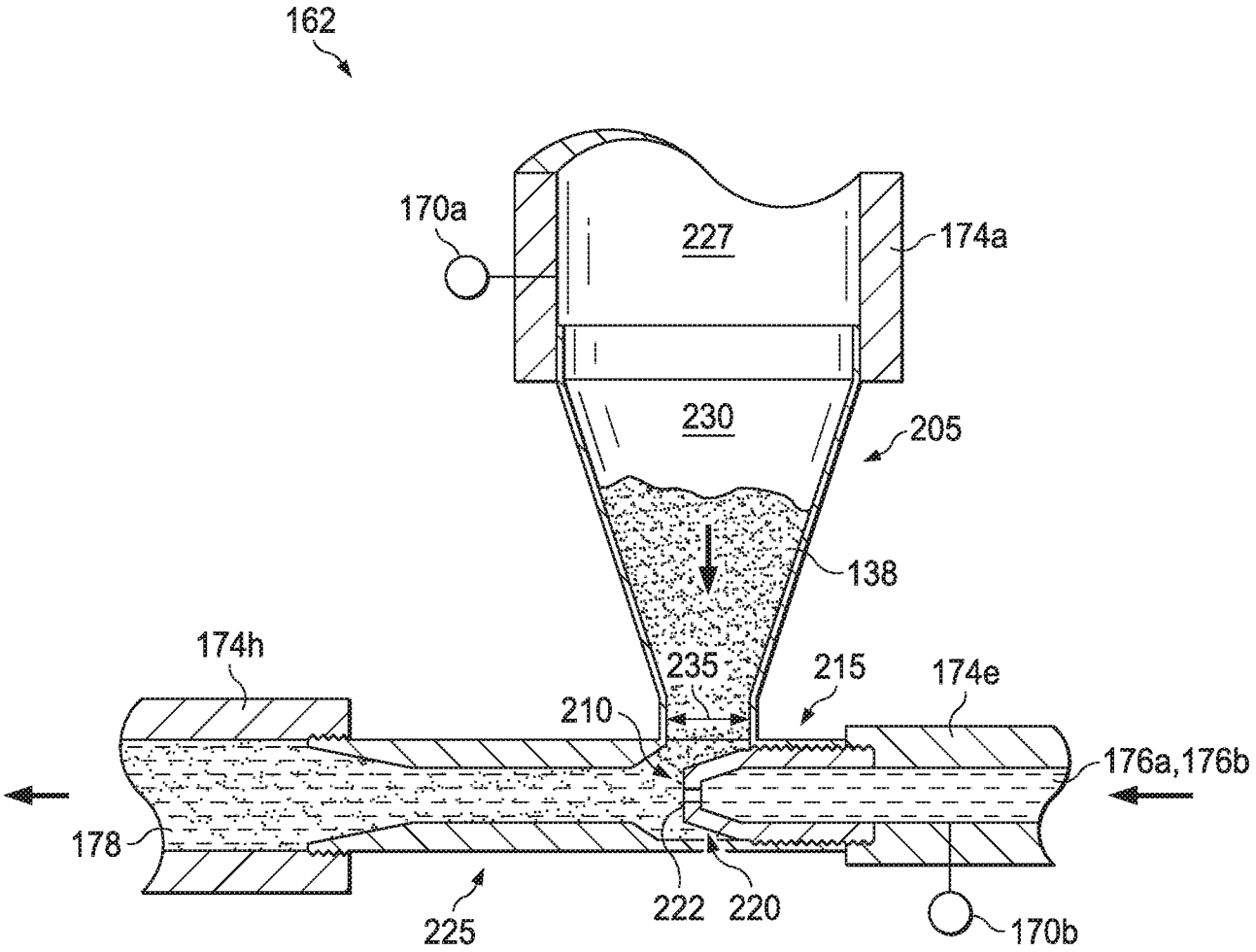

Reference is now made to the following descriptions taken in conjunction with the accompanying drawings, in which:

FIG. 1 presents a schematic view of an illustrative embodiment of an oil and gas well drilling system, using a solids discharge assembly and method for disposing of oil or gas well treated solids in accordance to embodiments of the disclosure;

FIG. 2 presents a cross-sectional view of an eductor of the solids discharge assembly including any embodiments of the assembly used in the oil and gas well drilling system disclosed in the context of FIG. 1; and FIGS. 3A and 3B present a schematic flowchart of an illustrative embodiment of a method for disposing of oil or gas well treated solids, including disposing of treated solids using any embodiments of the system and assemblies disclosed in the context of FIGS. 1-2.

DETAILED DESCRIPTION

The present disclosure relates generally to the field of oil or gas well waste solids processing, and more specifically, to systems, solids discharge assemblies and methods for the disposal of treated solids.

As part of the present disclosure we recognized that the discharge of treated solids can be facilitated by using an eductor, as part of a solids discharge assembly, to carry the treated solids away from a treatment process without the need to break the vacuum of upstream components used to form the treated solid, and, without the need to isolate the treated solids before being discharged. Additionally, embodiments of the solids discharge assembly as disclosed herein avoid or reduce the use of several conventional components (e.g., valves, augers, water cooling jackets, and instruments to control the management of removing solids from vacuum to atmospheric pressure conditions) that are prone to wear down and replacement. Consequently, embodiments of the solids discharge assembly as disclosed herein reduce the foot print of the assembly for discharging the solids and thereby provide additional space to accommodate additional upstream components to thereby increase the throughput of forming the treated solids.

FIG. 1 presents a schematic view of an illustrative embodiment of an oil and gas well drilling system 100 of the disclosure, the system 100 using any assembly or method embodiments for processing oil or gas well treated solids as disclosed herein. FIG. 1 generally depicts a water-based drilling system, e.g., for sub-sea drilling operations employing floating or sea-based platforms or rigs 101. Those skilled in the pertinent art would understand the system components described herein are equally applicable to land-based drilling system without departing from the scope of the disclosure.

As illustrated, the system 100 may include a drilling platform 102 that supports a derrick 104 having a traveling block 106 for raising and lowering a drill string 105. The drill string 105 may include, but is not limited to, drill pipe and coiled tubing, as generally known to those skilled in the art. A kelly 109 may support the drill string 105 as it is lowered through a rotary table 107. A drill bit 108 may be attached to the distal end of the drill string 105 and may be driven either by a downhole motor and/or via rotation of the drill string 105 from the well surface. The drill bit 108 may include, but is not limited to, roller cone bits, polycrystalline diamond compact (PDC) bits, natural diamond bits, any hole openers, reamers, coring bits, etc. As the drill bit 108 rotates, it may create a wellbore 110 that penetrates various subterranean formations 112.

One or more pumps 114 (e.g., a mud pump) and reservoirs 116 (e.g., a mud reservoir) of the system 100 can provide an oil or gas well drilling fluid 122. For instance, the fluid 122 can include constituents such as drilling mud or oil-based slurry compositions include oil, water and solids, or other fluids, as familiar to those skilled in the pertinent art. The pump 114 can circulate the fluid 122 through flow conduits 124 to the kelly 109, which in turn conveys the fluid 122 downhole through the interior of the drill string 105 and through one or more orifices in the drill bit 108. The fluid 122 may then be circulated back to the surface via an annulus 126 defined between the drill string 105 and the walls of the wellbore 110.

At the surface, the fluid 122 returning from the wellbore 110 may exit the annulus 126 and be conveyed to a fluid processing unit 128 via an interconnecting flow line 130. The fluid processing unit 128 may include, but is not limited to, a shaker unit to facilitate separating the oil or gas well drilling fluids into a phase of liquid 132 and a phase of waste solids 134. The shaker unit can include one or more vibrating sieves with a wire-cloth screen configured to vibrate while the returning oil or gas well drilling fluids 122 flows on top of it such that components of the fluid 122 that are smaller than the wire mesh pass through the screen (e.g., number 150, 200 and/or 300 screen sizes) as the phase of liquid 132, while the phase of waste solids 134 includes the components that are retained by the wire mesh. As familiar to those skilled in pertinent arts, some embodiments of the fluid processing unit 128 can further include centrifuges, separators, desilters, desanders, or filters to facilitate the further separation into the liquid and waste solids 132, 134.

The liquid 132 can be transported from the fluid processing unit 128 to the reservoir 116 for reuse as part of the drilling fluid 122, while the waste solids 134 can be transported to a thermal extraction unit 136 for further processing to form oil and gas well treated solids 138.

Additionally, as the liquid phase 132 is recovered and reused as part the drilling fluid 122, the eventual accumulation of large quantities of ultrafine particles (e.g., having an average particle size of 50, 10 or 5 microns or less), often referred to a low gravity solids, eventually renders the liquid phase no longer useful as a drilling fluid. In such cases, the liquid 132 may then deemed to be a spent drilling fluid and the low gravity solids in the liquid 132 can be further processed and become part of the waste solids 134 transferred to the thermal extraction unit 136.

For instance, the waste solids 134 can be transported via a feed line 140 to the thermal extraction unit 136 which is configured to treat the waste solids 134 by extracting valuable hydrocarbon gases and water vapor from the waste solids with the reminder forming treated solids 138. For instance, the thermal extraction unit 136 can include a thermal extraction barrel 142 configured to heat and expose the waste solids 134 to a turbulent thin film flow regime while maintaining a reduced pressure of less than the ambient atmospheric pressure (e.g., less than 1 atmosphere, e.g., less than 0.7, 0.8, 0.9 of the ambient atmospheric pressure, in some embodiments), to facilitate extracting the hydrocarbon and water vapor from the waste solids 134.

The extracted hydrocarbon gases and water vapor can be transported via vent tube 144 and gas lines 145*a* for further processing in one or more cyclone separators 146*a*, 146*b* to further extract the hydrocarbon gases and water vapor which can then be transported to a condenser unit 148. In some embodiments, the condensed liquid water or hydrocarbon liquid may be sent from the condenser unit 148 to the reservoir 116 for reuse as part of formulating the drilling fluid 122, e.g., serving as a fluid premix.

To facilitate drawing the hydrocarbon gases and water vapor from the thermal extraction unit 136, and in some embodiments, into the cyclone separators 146*a*, 146*b*, the thermal extraction unit 136 and cyclone separators 146*a*, 146*b* can be connected (e.g., via gas lines 145*a*, 145*b*) to a primary eductor 152 configured to form the reduced pressure and to transfer hydrocarbons to the reservoir 116 (e.g., via gas line 145*c*).

A solids cooling conveyor 154 can be connected to transport (e.g., via auger 156 and gravity feed) the cooled oil and gas well treated solids 138 to a solids discharge assembly 160 for disposal of the treated solids 138, while maintaining the reduced pressure. In some embodiments, the conveyor 154 can be additionally connected (e.g., via gas lines 145*a*) to transport further extracted hydrocarbon gases and water vapor from the conveyor 154 to one or more of the cyclone separators 146*a*, 146*b*.

The term waste solids as used herein refers to solids separated from drilling fluid that has returned from a well bore and/or low gravity solid recovered from spent drilling fluid. As familiar to those skilled in art waste solids can includes solid particulate objects, including limestone, shale, clay, bentonite objects, of all shapes, composition and morphology present in drilling fluid and downhole formation cuttings and well as hydrocarbons and water that resides on or in such solids. For instance in some embodiments, the waste solids 134 can have a hydrocarbon content of 5 wt % or more and/or water content of 1 wt % or more.

The term treated solids as used herein refers waste solids that have been processed to extract hydrocarbons and water. For instance, in some embodiment the waste solids can be thermally treated in a reduced pressure environment, e.g., as processed in a thermal extraction unit 136 and the one of more optional cyclone units 146*a*, 146*b* to remove hydrocarbons and water to form the treated solids. For instance, in some embodiments, the resulting treated solids 138 can have a hydrocarbon content of 5, 4, 2 or 1 wt % or less and a water content of 1 or 0.1 wt % or less.

As illustrated in FIG. 1, embodiments of the assembly 160 can include a discharge eductor 162 and solids valve 164*a*. Some embodiments can further include one or more of: a second solids valve 164*b*, discharge valve 164*c*, sampling valve 164*d*, fluid pump 166, solids feeder 168, pressure transmitters 170*a*, 170*b*, 170*c*, 170*d* 170*e*, sampling tank 172, and, solids conduit (e.g. solids conduit portions 174*a*, 174*b*, 174*c*, 174*d*), fluids conduit (e.g., fluid conduit portions 174*e*, 174*f*, 174*g*) or discharge conduit (e.g., discharge conduit 174*h*), to couple the components of the assembly 160 together. For instance, the treated solids 138 can be transferred to the eductor 162 via one or more of the solids conduit portions 174*a*, 174*b*, 174*c*, 174*d* as controlled by first and second solids valves 164*a*, 164*b*, a motive fluid (e.g., fluid 176*a* and/or fluid 176*b*) can be pumped by the fluid pump 166 to the eductor 162 via the fluids conduit portions 174*e*, 174*f*, 174*g*, a discharge mixture 178 of the motive fluid 176*a*, 176*b* and the treated solids 138 can be discharged from the eductor 162 via a discharge conduit 174*h* as controlled by the discharge valve 164*c*, and portions of the discharge mixture 178 can be drawn from the discharge conduit 174*h* into the sampling tank 172 as controlled by a sampling valve 164*d*.

FIG. 2 presents a cross-sectional view of an embodiment of the discharge eductor 162 of the assembly (e.g., assembly 160), including any embodiments of the assembly 160 as used in the oil and gas well drilling system 100 disclosed in the context of FIG. 1 or in the method 300 discussed in the context of FIGS. 3A and 3B.

With continuing reference to FIGS. 1 and 2 throughout, some embodiments of the assembly 160 include a discharge eductor 162. The discharge eductor 162 includes a solids inlet 205 configured to receive the treated solids 138 (e.g., as obtained from oil and gas well waste solids 134 and transported and cooled in the conveyor 154), and, to transport the treated solids 138 to a chamber 210 of the discharge eductor 162. The eductor 162 includes a fluid inlet 215 configured to receive a motive fluid 176*a*, 176*b* and transport the motive fluid 176*a*, 176*b* through a tapered nozzle 220 coupled to the fluid inlet 215, a tip 222 of the tapered nozzle 220 located in the chamber 210. The eductor 162 includes a discharge outlet 225 configured to receive a discharge mixture 178 of the treated solids 138 and the motive fluid 176*a*, 176*b* from the chamber 210. The chamber 210 is configured to have a reduced pressure of less than atmospheric pressure when the motive fluid 176*a* is streaming from the fluid inlet 215 to the discharge outlet 225.

As illustrated in FIG. 1, embodiments of the assembly 160 also include a solids valve 164*a* located in a solids conduit (e.g., solids conduit portions 174*a*, 174*b*) coupled to the solids inlet 205 of the discharge eductor 162. The solids conduit 174*a* is evacuated and the solids valve 164*a* is configured to be closed to prevent the transfer of the treated solids 138 into the solids inlet 205 and to prevent the flow of the motive fluid 176*a* 176*b* into the solids conduit 174*a*, when the chamber 210 has a pressure equal to or greater than atmospheric pressure, and, open to permit the transfer of the treated solids 138 into the solids inlet 205, when the chamber 210 has the reduced pressure of less than atmospheric pressure.

The term motive fluid as used herein refers to a motive fluid of air (e.g., ambient air motive fluid 176*a* surrounding the rig 101) or a motive fluid of liquid water (e.g., sea water or lake water 176*b* surrounding or in the vicinity of the rig 101), or a fluid having mixture of air and liquid water.

The term evacuated as used herein refers to an interior of the solids conduit (e.g., interior 227 or solid conduit portion 174*a*) having a pressure (e.g., as measured by pressure transmitter 170*a*) of less than atmospheric pressure and the interior being substantially free of the motive fluid 176*a*, 176*b*. Motive fluid in the interior of the solids conduit, or an interior of the solids inlet 205 (e.g., interior 230) coupled to the solids conduit, could undesirably generate water vapors that could disrupt the reduced pressure in the vent tube 144 or gas lines 145*a*, 145*b*, 145*c*) or, in components of the system 100 that are located upstream from the assembly 160 (e.g., the thermal extraction unit 136, cyclones 146*a*, 146*b*, primary eductor 152, or conveyor 154). The subsequent loss of the reduced pressure, in turn, could disrupt the processes to form the treated solids 138. For instance, during the operation of the discharge eductor 162, there is substantially no standing column of water (e.g., from the motive fluid 176*a*, 176*b*) in the solids conduit (e.g., solids conduit portion 174*a*) or the solids inlet 205 (e.g., less than 1 vol % of the total volume of the interior 227 of the solid conduit portion 174*a* or the interior 230 of the solids inlet 205).

The solids valve 164*a* can have any number of different designs, which when opened, allows flow of the treated solids 138 to the discharge eductor 162, or when closed, prevent the flow of the treated solids 138, e.g., to facilitate isolating the discharge eductor 162 from the solids conduit 174*a* and the upstream components of the system 100 and lines (e.g. when initially forming the reduced pressure in the chamber 210 solids inlet 205 on startup of the assembly 160) until steady state reduced pressure conditions are achieved. Non-limiting examples of solids valve 164*a* design includes rotary air locks, knife gate valves, rotary ball valves, or inflatable dome valves. In some embodiments, knife gate valves or dome valves may be less prone to wear or clogging from the flow of the treated solids 138 there-through.

The reduced pressure generated in the solids inlet 205 and the chamber 210 are closely monitored and controlled to help maintain a continuous reduced pressure throughout the assembly 160 and the upstream components of the system 100.

For instance, in some embodiments, to generate the reduced pressure in the chamber 210 a pressure (e.g., as measured by pressure transmitter 170*b*) of the motive fluid 176*a*, 176*b* at the fluid inlet 215 is a value in a range from 20 to 100 psig.

In some embodiments, a fluid pump 166 of the assembly 160 is configured to provide a flow of the motive fluid 176*a*, 176*b* (e.g., up to 100 to 1000 G/min or 300 to 600 G/min, in some embodiments) through a fluid conduit (e.g., fluid conduit portion 174*e*) coupled to the fluid inlet 215. Non-limiting example configurations of the fluid pump 166 include centrifugal or progressive cavity pumps or air compressors.

The fluid pump 166 is closely controlled to continuously maintain the reduced pressure of the chamber 210 in the desired range.

For instance, a motor (M) configured to drive the fluid pump 166 can be controlled (e.g., via a variable frequency drive (VFD) controlling the moto) to reduce the motive fluid 176*a*, 176*b* flow rate when the fluid pressure at the fluid inlet 215 (e.g., as measured by pressure transmitter 170*b*) is greater than 100 psig. For instance, in some embodiments, when the motive fluid's pressure at the fluid inlet 215 exceeds 100 psig, the reduced pressure in the chamber 210 can create a strong enough vacuum in the solids conduit (e.g., solids conduit portions 174*a*-174*d*) and the upstream components of the system 100 to cause hydrocarbon gases to be sucked down into the assembly 160 and thereby be undesirably discharged into the discharge conduit 174*h*, instead of being drawn, by the vacuum created by the primary eductor 152, to the cyclones 146*a*, 146*b* and stored in the condenser unit 148.

For instance, in some embodiments, the solids valve 164*a* can be configured to close when the fluid pressure of the motive fluid 176*a*, 176*b* at the fluid inlet 215 (e.g., as measured by pressure transmitter 170*b*) is less than 20 psig. For instance, in some embodiments, when the motive fluid pressure at the fluid inlet 215 is less than 20 psig, the reduced vacuum conditions in the chamber 210 and subsequent increased pressure in the solids inlet 205 can cause the motive fluid 176*a*, 176*b* to be drawn up into the solids conduit 174*a* (e.g., due to a stronger vacuum created by the primary eductor 152) and into the upstream components of the system 100 thereby disrupting the processes to form the treated solid 138.

In addition to being configured to be closed at the assembly's start up, when the chamber 210 has a pressure equal to or greater than atmospheric pressure, the solids valve 164*a* can also be configured to close, e.g., because the discharge eductor 162, solids inlet 205 or the upstream components of the system 100 become clogged, or because the primary eductor 152 generates a reduced pressure that is imbalanced (e.g., substantially higher or lower) than the reduced pressure generated by the discharge eductor 162, or because hydrocarbons previously absorbed in the treated solids 138 become desorbed to formed gases in the upstream portion of the solids conduit 174*b*.

For instance, in some embodiments, the solids valve 164*a* can be configured to close when there is a pressure imbalance of 2 psig or greater (or 1 psig or 0.5 psig or greater in some embodiments) between a portion of the solids conduit (e.g., solids conduit portion 174*b*) upstream from the solids valve 164*a* and the portion of the solids conduit downstream from the solids valve 164*a* and coupled to the solids inlet 205 of the discharge eductor 162 (e.g., solids conduit portion 174*a*). For instance, in some embodiments a reduced pressure value outside of the range from 20 to 100 psig and/or a pressure differential between the discharge eductor 162 and the primary eductor 152 of greater than ±2, ±1 psig or ±0.5 psig can cause the solids valve 164*a* to close.

Embodiments of the discharge eductor 162 can be configured to accommodate a treated solids 138 discharge flow rate of at least about 100 kg of treated solids per hour, and in some embodiments a discharge flow rate value in a range of from 200 to 2000 kg of treated solids per hour. For instance, in some embodiments, the interior 230 of the solids inlet 205 of the discharge eductor 162 can have cross-sectional area value in a range from at least about 7 to 20 inch to accommodate an intake flow rate of solids 138 equal to or greater the treated solids discharge flow rate. For instance, when the solids inlet 205 has a circularly shaped cross-sectional area a minimal diameter 235 of the solids inlet 205 can be a value in a range from about 3 to 5 inches. In some embodiments the solids inlet 205 can be shaped as a straight cylindrical tube having a fixed diameter 235 in such a range of diameters. However, in other embodiments, such as shown in FIG. 2, to provide a greater buffer volume for accumulating treated solids 138 and to facilitate the solids 138 feed into the eductor chamber 210, the solids inlet 205 can have a hopper or funnel shape that tapers from a maximal cross-sectional area that is five to ten times greater than a minimal cross-sectional area. For instance, in some embodiments, the diameter 235 of a circularly shaped interior 230 of the solids inlet 205 can gradually decrease to about ⅓ of its maximal diameter 230, e.g., from 9 to 15 inches to 3 to 5 inches.

As illustrated in FIG. 1, to further regulate the continuous flow of treated solids 138 the assembly 160 can further include a solids feeder 168. The solids feeder 168 can be coupled to the solids conduit (e.g., solids conduit portions 174*b*, 174*c*) located upstream to the location of the solids valve 1645*a* in the downstream solids conduit (e.g., solids conduit portion 174*a*). The rotary solids feeder 168 can be configured to provide a metered delivery of the treated solids to the solids inlet 205 and to maintain the reduced pressure. Embodiments of the solids feeder 168 can be any solids metering device, as familiar to those skilled in the pertinent art, to provide a multi-chambered rotary device to facilitate the metered deliver of solids and to not cause a loss in the reduced pressure generated by the discharge eductor 162. For instance, the solids feeder 168 can be configured as a rotary airlock to deliver fixed volumes of treated solids via several rotating bins (e.g., each bin having a volume corresponding to 1, 2, 10, 20, 50 or 100 kg portions of the treated solid per bin, in various embodiments) rotating between the portions of the solids conduits 174*c* and 174*b* located upstream and downstream from the solids feeder 168.

One skilled in the art would understand how the solids feeder 168 could be configured to be sealed to withstand pressure imbalances between the portions of the solids conduits 174*b*, 174*c*, e.g., pressure imbalance of at least ±2, ±10 or ±20 psig without leaking hydrocarbon gas or water vapor into the solids conduit and thereby causing a loss in the reduced pressure.

The solids feeder 168 can be configured to stop rotating, and thereby close, if there is a such a pressure imbalance in the solids conduit portions located upstream (e.g., as measured by a pressure transmitter 170*c* in solids conduit portions 174*c* or 174*d*) and downstream (e.g., as measured by a pressure transmitter 170*d* in solid conduit portions 174*a* or 174*b*) from the solids feeder 168. The feeder 168 can thereby serve as an alternative or additional means to the solids valve 164*a* to mitigate against the loss of reduced pressure in the upstream components of the system 100 or the downstream portions of the assembly 160. For instance, analogous to the solids valve 164*a*, the feeder 168 can be configured to stop if there is a reduced pressure imbalance between the upstream and downstream solids conduit portions 174*c* and 174*b* (e.g., as measured by pressure transmitter 170*c* and pressure transmitter 170*d*, respectively).

As illustrated in FIG. 1, some embodiments, to prevent the solids feeder 168 and downstream components of the assembly 160, or upstream components of the system 100, from losing the reduced pressure, the assembly 160 can further include a second solids valve 164*b* located in a portion of the solids conduit (e.g., solids conduit portion 174*c* or 174*d*) located upstream from the location of the solids feeder 168. The second solids valve 164*b* can be configured to be: closed to prevent the transfer of the treated solids 138 to the solids feeder 168 when there is a pressure imbalance of 2 psig or greater (e.g., as measured by pressure transmitters 170*c* and 170*d*) between the portion of the solids conduit located upstream to solids feeder 168 and a portion of the solids conduit (e.g., solids conduit portion 174*a* or 174*b*) located downstream from the solids feeder 168 and open when the pressure imbalance of is less than 2 psig, and, open when the pressure imbalance of is less than 2 psig.

As shown FIGS. 1 and 2, embodiments of the assembly 160 can include pressure transmitters to facilitate monitoring of the various components of the assembly 160. For instance, embodiments of the assembly 160 can include one or more of: a first pressure transmitter 170*a* connected to the solids conduit (in solids conduit portion 174*a*) connecting the solids inlet 205 of the discharge eductor 162 and the solids valve 164*a*; a second pressure transmitter 170*b* located in a fluid delivery conduit (in fluid conduit portion 174*e*) connected to the fluid inlet 215 of the discharge eductor 162; a third pressure transmitter 170*c* connected to the solids conduit (in solids conduit portion 174*d*) connecting a solids feeder 168 of the assembly 160 to a solids conveyor; a fourth pressure transmitter 170*d* connected to the solids conduit (in solids conduit portion 174*b* upstream to the location of the solids valve) connecting the solids valve 164*a* and the solids feeder 168 connected to the solids conduit; and a fifth pressure transmitter 170*e* located in a discharge conduit 174*h* that is connected to the discharge outlet 225 of the discharge eductor 162.

As familiar to one skilled in the pertinent arts, each of the pressure transmitters 170*a*-170*e* of the assembly 160 can include a pressure sensor to measure the pressure inside the conduit and electronic circuitry to form an electrical signal 180 (e.g., via a digital signal processor of the circuit) that corresponds to the measured pressure and to transmit the electrical signal 180 by wired or wireless communication components.

As illustrated in FIG. 1, embodiments of the assembly 160 can further include a program logic circuit (PLC) 182 (e.g., a stand-alone PLC or used in combination with other monitoring equipment such as a computer) configured to receive the electrical signals 180 corresponding to pressures measured by the one or more pressure transmitters 170*a*-170*e* and to transmit electrical control signals 184 to actuate one or more of the solids valve 164*a*, second solids valve 164*b*, discharge valve 164*c*, solids feeder 168 or a fluid pump 166 configured to provide a flow of the motive fluid 176*a* 176*b* to the eductor 162. For instance, as familiar to one skilled in the pertinent arts, each of the valves 164*a*, 164*b*, 164*c*, the pump 166 and the feeder 168 can include electrical circuitry to receive the electrical control signals 184 and then control motors that change the operational status of the valve, pump or feeder, e.g., to facilitate generating or maintaining the reduced pressure such as disclosed herein.

As illustrated in FIG. 1, embodiments of the assembly 160 can further include a sampling tank 172 coupled to the discharge outlet 255 (e.g., via discharge conduit 174). The sampling tank 172 can be configured to receive portions of the discharge mixture 178 (e.g., as controlled by the discharge valve 164*d*). For instance, the discharge mixture 178 can be sampled at regular intervals by drawing portions of the discharge mixture 178 into the sampling tank 172 for subsequent analysis of the discharge mixture 178 to measure and verify that the hydrocarbon content of discharge mixture 178 meets target regulatory standards (e.g., less than 5, 2, or 1 wt % hydrocarbon per dry weight of treated solids 138 in the discharge mixture 178. In some embodiments, the discharge mixture 178 can include less than 1 wt % of the treated solids 138 per unit weight of the discharge mixture 178 (e.g., the ratio of treated solids 138 to a motive fluid 176 of water equals about 1:99).

As illustrated in FIG. 1, embodiments of the assembly 160 can further include a discharge valve 164*c* located in a discharge conduit 174*h* that is coupled to the discharge outlet 225 of the eductor 162. The discharge valve 164*c* can be configured to be closed if the discharge conduit 174*h* has a pressure (e.g., as measured by the pressure transmitter 170*e*) that is above an ambient air pressure surrounding the assembly 160 and to be open if the pressure in the discharge conduit 174*h* is equal to or below the ambient air pressure. For instance, in some embodiments, the discharge conduit 174*h* may be submerged and discharge the discharge mixture 178 directly into a body of water 190 (e.g., a lake or ocean) surrounding or in the vicinity of the rig 101. In some such embodiments, the discharge conduit 174*h* can become plugged by objects 192 (e.g., sea life) in the body of water 190, resulting in an increase in the pressure in the discharge conduit 174*h* above ambient air pressure.

In any of the above discussed scenarios that could cause any of the solids valves 164*a*, 164*b*, 164*c* to close or the fluid pump 166 or the feeder 168 to slow or stop, the PLC 182, in addition to actuating components of the assembly 160 as disclosed above, can also be configured to raise an alarm to alert an operator to check for blockages or other malfunctions in the assembly 160 or upstream components of the system 100.

Another embodiment of the disclosure is the oil and gas well drilling system 100 that includes the assembly 160 such as any of the embodiments of the assembly 160 and any of the upstream components of the system 100 as discussed in the context of FIGS. 1 and 2.

For instance, with continuing reference to FIGS. 1 and 2 throughout, embodiments of the system 100 can include a thermal extraction unit 136 and a solids discharge assembly 160 for disposing of treated solids 138.

The thermal extraction unit 136 can be configured to receive a feed (e.g., via the feed line 140) of oil and gas well waste solids 134 and to extract hydrocarbon and water vapor from the waste solids to form the treated solids 138 while the treated solids 138 are maintained at a first reduced pressure of less than atmospheric pressure.

The solids discharge assembly 160 can include a discharge eductor 162 and a solids valve 164*a*. The discharge eductor 162 including a solids inlet 205, chamber 210, fluid inlet 215 and discharge outlet 225. The solids inlet 205 can be configured to receive the treated solids 138, and, to transfer the treated solids 138 to the chamber 210. The fluid inlet 215 can be configured to receive a motive fluid 176*a*, 176*b* and transport the motive fluid 176*a*, 176*b* through a tapered nozzle 220 coupled to the fluid inlet 215, a tip 222 of the tapered nozzle 220 located in the chamber 210. The discharge outlet 225 can be configured to receive a discharge mixture 178 of the treated solids 138 and the motive fluid 176*a*, 176*b* from the chamber 210. The chamber 210 has a second reduced pressure of less than atmospheric pressure when the motive fluid 176*a*, 176*b* is streaming from the fluid inlet 215 to the discharge outlet 225. The solids valve 164*a* is located in the solids conduit 174*a* coupled to the solids inlet 205 of the discharge eductor 162. The solids conduit 174*a* is evacuated and the solids valve 164*a* is configured to be: closed to prevent the transfer of the treated solids 138 into the solids inlet 205 and to prevent the flow of the motive fluid 176*a* 176*b* into the evacuated solids conduit 174*a* when the chamber 210 has a pressure equal to or greater than atmospheric pressure, and, to be open to permit the transfer of the treated solids 138 into the solids inlet 205 when the chamber 210 has the second reduced pressure.

For instance, in some embodiments, the solids value 164*a* is configured to be open when a pressure imbalance between the first reduced pressure and the second reduced pressure is 2 1 or 0.5 psig or less.

Some embodiments of the system 100 can further include a primary eductor 152 that is coupled to the thermal extraction unit 136. The primary eductor 152 can be configured to generate the first reduced pressure (e.g., as measured by a pressure transmitter 194) in the thermal extraction unit 136. The primary eductor 152 can be coupled to the thermal extraction unit 136 via the vent tube 144 and gas lines 145*a* 145*b* either indirectly via one or more cyclone separators 146*a*, 146*b* or the conveyor 154, or, directly via separate gas lines directly coupled to the vent tube 144. The primary eductor 152 could have various designs as familiar to those skilled in the pertinent art. Embodiment of primary eductor 152 and/or the discharge eductor 162 can be controlled to generate the first and second reduced pressure ranges, respectively, which are substantially equal to each other (e.g., within ±2, 1, or 0.5 psig in various embodiments).

Some embodiments of the system 100 can further include a solids cooling conveyor 154. The solids cooling conveyor 154, while at the first reduced pressure, is configured to receive the treated solids 138 from the thermal extraction unit 136 and to cool and transfer the treated solids 138 to the solids conduit 174*a* of the solids discharge assembly 160.

In some embodiments, to facilitate further removal hydrocarbon and water vapor before they condense in the conveyor 154 and get transferred to the assembly 160 as part of treated solids, one or more cyclone separators 146*a*, 146*b* of the system 100 can be coupled to the solids cooling conveyor 154. While also at while the first reduced pressure, the cyclone separators 146*a*, 146*b* can be configured to receive additional amounts of the hydrocarbon and water vapor from the solids cooling conveyor 154 (e.g., via gas lines 145*a* coupled to the conveyor 154) to extract additional amounts of the treated solids 138 therefrom with the additional amounts of the hydrocarbon and water vapor being transferred to the condenser unit 148. In some such embodiments, the cyclone separators 146*a*, 146*b* can be configures to transfer the additional amounts of the treated solids 138 to the evacuated solids conduit 174*a* to a second one of the solids discharge assemblies 160*a*.

In some embodiments, the second solids discharge assembly 160*a* can include completely separate ones of all of the components of the assembly 160, e.g., separate ones of a discharge eductor 162, valves 164*a* . . . 164*d*, fluid pump 166, solid feeder 168, pressure transmitters 170*a* . . . 170*e*, sampling tank 172 and conduits 174*a* . . . 174*h* or PLC 182. However, in some embodiments the second assembly 160*a* can share same components with the first assembly 160, e.g., portions of the discharge conduit 174*h* and connected pressure transmitter 170*e* and discharge valve 164*c*. For instance, the sampling tank 172 can sample a discharge mixture 178 that is a combination of discharge mixtures from both the first and second assemblies 160, 160*a*. For instance, a common PLC 182 can be configured to receive electrical signals 180 from separate or common pressure transmitters both the first and second assemblies 160, 160*a* and send control signals 184 to control the various components of the both assemblies 160, 160*a*.

In some embodiments of the system having such a second assembly 160*a*, the second assembly 160*s* or a third assembly may be configured to hydrocarbon and water vapor from the only the thermal extraction unit 136 and not from the solids cooling conveyor 154. For instance, one or more cyclone separators 146*a*, 146*b*, while at the first reduced pressure can be configured to receive the hydrocarbon and water vapor from the thermal extraction unit 136 (e.g., directly via the vent tube 144 and gas lines 145*a* coupled directly to the cylones separators 146*a*) and extract additional amounts of the treated solids 138 therefrom and transfer the additional amounts of the treated solids 138 to a second one of the solids discharge assembly 160*a*.

Another embodiment of the disclosure is a method for disposing of oil or gas well treated solids. FIGS. 3A and 3B present a schematic flowchart of an illustrative embodiment of a method 300 for disposing of oil or gas well treated solids, including disposing of treated solids using any embodiments of the system 100 and assemblies 160, 160*a* disclosed in the context of FIGS. 1-2.

With continuing reference to FIGS. 1-3 throughout, the method 300 includes receiving (step 305) treated solids 138 into a solids conduit (e.g., one of the solids conduit portions 174*a*, 174*b*, 174*c*, or 174*d* in various embodiments) coupled to a solids inlet 205 of a discharge eductor 162 and transferring (step 310) the treated solids 138 to a chamber 210 of the discharge eductor 162. The method further includes transporting (step 315) a motive fluid 176*a*, 176*b* to a fluid inlet 215 of the discharge eductor 162 and through a tapered nozzle 220 of the discharge eductor 162 coupled to the fluid inlet 215, a tip 222 of the tapered nozzle 220 located in the chamber 210. The method also includes discharging (step 320) a discharge mixture 178 of the treated solids 138 and the motive fluid 176*a*, 176*b* from the chamber 210 to a discharge outlet 225 of the discharge eductor 162. The solids conduit is evacuated and a solids valve 164*a* located in the solids conduit is configured to close (step 325) when the chamber 210 has a pressure equal to or greater than atmospheric pressure, to prevent the transfer of the treated solids 138 into the solids inlet 205 and to prevent the flow of the motive fluid 176*a* 176*b* through the solids conduit when the chamber 210 has a pressure equal to or greater than atmospheric pressure and to open (step 330) to permit the transfer of the treated solids 138 into the solids inlet 205 when the chamber 210 has the reduced pressure.

In some embodiments, the transporting of the motive fluid 176*a*, 176*b* (step 315) can include pumping (step 340) the motive fluid 176*a*, 176*b* through a fluid pump 166 to provide a flow of the motive fluid 176*a*, 176*b* through a fluid conduit 174*e*, 174*f*, 174*g* coupled to the fluid inlet 205, and, also include reducing (including stopping) the flow (step 350) (e.g., via a motor driving the fluid pump) of the pumped motive fluid when the fluid pressure at the fluid inlet 205 is greater than 100 psig.

Some embodiments of the method 300 further include transporting (step 355) the treated solids 138 to the solids conduit (e.g., the solids conduit portions 174*a*, 174*b*, 174*c*, or 174*d* receiving the treated solids 138 as part of step 305) by a solids feeder 168 coupled to the solids conduit and located upstream to the location of the solids valve in the solids conduit, wherein the rotary solids feeder is configured to provide a metered delivery of the treated solids to the solids inlet and to maintain the reduced pressure. For some such embodiments of the method 300 a second solids valve 164*b* located in a portion of the solids conduit (e.g., solids conduit portion 174*c*) located upstream to the location of the solids feeder 168 in configured to close (step 360) to prevent the transfer of the treated solids 138 to the solids feeder 168 when there is a pressure imbalance of 2 psig or greater between the portion of the solids conduit 174*c* located upstream to the location of the solids feeder and a portion of the solids conduit (e.g., solids conduit portion 174*d* located downstream from the solids feeder 168 and configured to open (step 365) when the pressure imbalance is less than 2 psig.

In some embodiments, a discharge valve 164*c* located in a discharge conduit 174*h* coupled to the discharge outlet 225 of the eductor 162, wherein the discharge valve 164*c* is configured to close (step 370) if the discharge conduit 174*h* has a pressure that is above an ambient air pressure and to open (step 375) if the pressure in the discharge conduit 174*h* is equal to or below the ambient air pressure.

Some embodiments of the method 300 further include transferring (step 380) a portion of the discharge mixture 178 to a sampling tank 172 coupled to the discharge outlet 225 (e.g., via discharge conduit 174*h*) and measuring (step 385) a dry weight hydrocarbon content of the portion the discharge mixture 178.

Some embodiments of the method 300 further include further including receiving electrical signals 180 by a PLC 182 (step 390), the electrical signals 180 corresponding to pressures measured by the one or more pressure transmitters 170*a*-170*e* connected to the solids conduit, a fluid conduit 174*e* coupled to the fluid inlet 215 or a discharge conduit 174*h* coupled to the discharge outlet 225. Some such embodiments can further include transmitting electrical control signals 184 by the PLC 182 (step 395) to actuate (e.g., actuating one or more of steps 325, 330, 340, 350, 355, 360, 365, 375) one or more of the solids valves 164*a*, second solids valve 164*b*, discharge valve 164*c*, solids feeder 168 or a fluid pump 166 configured to provide a flow of the motive fluid 176*a* 176*b* to the eductor 162 to maintain the reduced pressure.

Those skilled in the art to which this application relates will appreciate that other and further additions, deletions, substitutions and modifications may be made to the described embodiments.

What is claimed is:

1. A solids discharge assembly for disposing of oil and gas well treated solids, the assembly comprising:

a discharge eductor, the discharge eductor including:

a solids inlet to receive the treated solids from a thermal extraction unit, wherein the treated solids are maintained at a first reduced pressure of less than atmospheric pressure, and, to transfer the treated solids to a chamber of the discharge eductor, a fluid inlet to receive a motive fluid and transport the motive fluid through a tapered nozzle coupled to the fluid inlet, a tip of the tapered nozzle located in the chamber, and a discharge outlet to receive a discharge mixture of the treated solids and the motive fluid, from the chamber, wherein the chamber to maintains a second reduced pressure of less than atmospheric pressure when the motive fluid is streaming from the fluid inlet to the discharge outlet; and a solids valve located in a solids conduit coupled to the solids inlet of the discharge eductor, wherein solids conduit is evacuated and the solids valve is:

closed to prevent the transfer of the treated solids into the solids inlet and to prevent the flow of the motive fluid through the solids conduit when the chamber has a pressure equal to or greater than atmospheric pressure, and open to permit the transfer of the treated solids into the solids inlet when the chamber has the second reduced pressure.

2. The assembly of claim 1, wherein the second pressure is less than the first pressure.

3. The assembly of claim 1, further including a fluid pump to provide a flow of the motive fluid through a fluid conduit coupled to the fluid inlet, wherein a motor driving the fluid pump is controlled to reduce the flow of the motive fluid when the fluid pressure at the fluid inlet is greater than 100 psig.

4. The assembly of claim 1, wherein the solids valve is closed when the fluid pressure at the fluid inlet is less than 20 psig.

5. The assembly of claim 1, wherein the solids valve closes when there is a pressure imbalance of 2 psig or greater between a portion of the solids conduit upstream from the solids valve and a portion of the solids conduit downstream from the solids valve and coupled to the solids inlet of the discharge eductor.

6. The assembly of claim 1, wherein an interior of the solids inlet of the discharge eductor has a minimal cross-sectional area value in a range from at least about 7 to 20 $inch^2$.

7. The assembly of claim 1, wherein the solids inlet of the discharge eductor tapers from a maximal cross-sectional area at an opening of the solids inlet to a minimal cross-sectional area at an opening to the chamber of the discharge eductor.

8. The assembly of claim 1, further including a solids feeder coupled to the solids conduit and located upstream to the location of the solids valve in the solids conduit, wherein the solids feeder provides a metered delivery of the treated solids to the solids inlet and to maintain the reduced pressure.

9. The assembly of claim 8, further including a second solids valve located in a portion of the solids conduit located upstream to the location of the solids feeder, the second solids valve to be:

closed to prevent the transfer of the treated solids to the solids feeder when there is a pressure imbalance of 2 psig or greater between the portion of the solids conduit located upstream to the location of the solids feeder and a portion of the solids conduit located downstream from the solids feeder, and open when the pressure imbalance of is less than 2 psig.

10. The assembly of claim 1, further including a sampling tank coupled to the discharge outlet, the sampling tank to receive a portion of the discharge mixture.

11. The assembly of claim 1, further including a discharge valve located in a discharge conduit coupled to the discharge outlet of the eductor, wherein the discharge valve to be:

closed if the discharge conduit has a pressure that is above an ambient air pressure surrounding the apparatus, and open if the pressure in the discharge conduit is equal to or below the ambient air pressure.

12. The assembly of claim 1, wherein the second pressure is equal to or less than the first pressure.

13. A solids discharge assembly for disposing of oil and gas well treated solids, the assembly comprising:

a discharge eductor, the discharge eductor including:

a solids inlet to receive the treated solids, and, to transfer the treated solids to a chamber of the discharge eductor, a fluid inlet to receive a motive fluid and transport the motive fluid through a tapered nozzle coupled to the fluid inlet, a tip of the tapered nozzle located in the chamber, and a discharge outlet to receive a discharge mixture of the treated solids and the motive fluid, from the chamber, wherein the chamber has a reduced pressure of less than atmospheric pressure when the motive fluid is streaming from the fluid inlet to the discharge outlet; and a solids valve located in a solids conduit coupled to the solids inlet of the discharge eductor, wherein solids conduit is evacuated and the solids valve is:

closed to prevent the transfer of the treated solids into the solids inlet and to prevent the flow of the motive fluid through the solids conduit when the chamber has a pressure equal to or greater than atmospheric pressure, and open to permit the transfer of the treated solids into the solids inlet when the chamber has the reduced pressure, and further including one or more of:

a first pressure transmitter connected to the solids conduit connecting the solids inlet of the discharge eductor and the solids valve;

a second pressure transmitter connected to a fluid delivery conduit connected to the fluid inlet of the discharge eductor;

a third pressure transmitter connected to the solids conduit connecting a solids feeder of the assembly to a solids conveyor;

a fourth pressure transmitter connected to the solids conduit connecting the solids valve and the solids feeder connected to the solids conduit; and a fifth pressure transmitter located in a discharge conduit connected to the discharge outlet of the discharge eductor.

14. The assembly of claim 13, further including a program logic circuit to receive electrical signals corresponding to pressures measured by the one or more pressure transmitters and to transmit electrical control signals to actuate one or more of the solids valve, a second solids valve upstream from the solids feeder, a discharge valve in the discharge conduit, the solids feeder or a fluid pump to provide a flow of the motive fluid to the eductor.

15. An oil and gas well drilling system, the system comprising:

a thermal extraction unit, the thermal extraction unit to receive a feed of oil and gas well waste solids and to extract hydrocarbon and water vapor from the waste solids to form treated solids, wherein the treated solids are maintained at a first reduced pressure of less than atmospheric pressure; and a solids discharge assembly for disposing of the treated solids, the assembly including:

a discharge eductor, the discharge eductor including:

a solids inlet to receive the treated solids, and, to transfer the treated solids to a chamber of the discharge eductor, a fluid inlet to receive a motive fluid and transport the motive fluid through a tapered nozzle coupled to the fluid inlet, a tip of the tapered nozzle located in the chamber, and a discharge outlet to receive a discharge mixture of the treated solids and the motive fluid from the chamber, wherein the chamber has a second reduced pressure of less than atmospheric pressure when the motive fluid is streaming from the fluid inlet to the discharge outlet; and a solids valve located in a solids conduit coupled to the solids inlet of the discharge eductor, wherein the solids conduit is evacuated and the solids valve is:

closed to prevent the transfer of the treated solids into the solids inlet and to prevent the flow of the motive fluid into the evacuated solids conduit when the chamber has a pressure equal to or greater than atmospheric pressure, and open to permit the transfer of the treated solids into the solids inlet when the chamber has the second reduced pressure.

16. The system of claim 15, wherein the solids value open when a pressure imbalance between the first reduced pressure and the second reduced pressure is 2 psig or less.

17. The system of claim 15, further including a primary eductor coupled to the thermal extraction unit, the primary eductor to generate the first reduced pressure in the thermal extraction unit.

18. The system of claim 15, further including a solids cooling conveyor, the solids cooling conveyor, while at the first reduced pressure, to receive the treated solids from the thermal extraction unit and to cool and transfer the treated solids to the solids conduit of the solids discharge assembly.

19. The system of claim 18, further including one or more cyclone separators coupled to the solids cooling conveyor, the one or more cyclone separators while at the first reduced pressure to:

receive additional amounts of the hydrocarbon and water vapor from the solids cooling conveyor to extract additional amounts of the treated solids therefrom, and transfer the additional amounts of the treated solids to a second one of the solids discharge assembly.

20. The system of claim 15, the system further including one or more cyclone separators, the one or more cyclone separators, while at the first reduced pressure, to:

receive the hydrocarbon and water vapor from the thermal extraction unit and extract additional amounts of the treated solids therefrom, and transfer the additional amounts of the treated solids to a second one of the solids discharge assembly.

21. A method for disposing of oil and gas well treated solids, the method comprising:

receiving treated solids into a solids conduit coupled to a solids inlet of a discharge eductor the treated solids from a thermal extraction unit, wherein the treated solids are maintained at a first reduced pressure of less than atmospheric pressure;

transferring the treated solids to a chamber of the discharge eductor;

transporting a motive fluid to a fluid inlet of the discharge eductor and through a tapered nozzle of the discharge eductor coupled to the fluid inlet, a tip of the tapered nozzle located in the chamber;

discharging a discharge mixture of the treated solids and the motive fluid from the chamber to a discharge outlet of the discharge eductor, wherein the chamber maintains a second reduced pressure of less than atmospheric pressure when the motive fluid is streaming from the fluid inlet to the discharge outlet; and wherein the solids conduit is evacuated and a solids valve located in the solids conduit to:

close to prevent the transfer of the treated solids into the solids inlet and to prevent the flow of the motive fluid through the solids conduit when the chamber has a pressure equal to or greater than atmospheric pressure, and open to permit the transfer of the treated solids into the solids inlet when the chamber has the second reduced pressure.

22. The method of claim 21, wherein the second pressure is equal to or less than the first pressure.

* * * * *